US005810184A

United States Patent [19]

Adams et al.

[11] Patent Number: 5,810,184

[45] Date of Patent: Sep. 22, 1998

[54] FITMENT HAVING REMOVABLE MEMBRANE

[75] Inventors: Brian M. Adams, Newark; Rawson L. Chenault, San Francisco; Laszlo G. Sandor, Fremont; Daniel Luch, Morgan Hill, all of Calif.

[73] Assignee: Portola Packaging, Inc., San Jose, Calif.

[21] Appl. No.: 808,682

[22] Filed: Feb. 28, 1997

Related U.S. Application Data

[63] Continuation of Ser. No. 380,832, Jan. 30, 1995, abandoned.

[51] Int. Cl.[6] ..... B65D 25/42

[52] U.S. Cl. ..... 215/45; 215/252; 215/341; 215/344; 220/258; 220/269

[58] Field of Search ..... 229/125.15, 125.05; 220/258, 269, 270, 359, 465; 222/541.9; 215/44, 45, 250, 252, 341, 343, 344

[56] References Cited

U.S. PATENT DOCUMENTS

| | | | |
|---|---|---|---|
| 2,971,671 | 2/1961 | Shakman . | |
| 3,057,537 | 10/1962 | Pollick . | |
| 3,223,269 | 12/1965 | Williams | 215/354 X |
| 3,458,080 | 7/1969 | Laurizio . | |
| 3,814,277 | 6/1974 | La Croce et al. . | |
| 3,990,603 | 11/1976 | Brochman . | |
| 4,200,196 | 4/1980 | Bashour | 215/341 X |
| 4,356,939 | 11/1982 | Fitte | 222/541.9 |
| 4,380,303 | 4/1983 | Allen et al. . | |
| 4,391,385 | 7/1983 | Rausing . | |
| 4,393,979 | 7/1983 | Ball et al. . | |
| 4,408,697 | 10/1983 | Yoshikawa et al. . | |
| 4,453,646 | 6/1984 | Harrild . | |
| 4,461,391 | 7/1984 | Davis | 215/252 |
| 4,513,876 | 4/1985 | Buchner . | |
| 4,540,102 | 9/1985 | Wiedmer | 215/344 |
| 4,573,601 | 3/1986 | Berglund | 215/252 |
| 4,625,875 | 12/1986 | Carr et al. . | |
| 4,664,278 | 5/1987 | Barriac | 215/252 |
| 4,669,640 | 6/1987 | Ando et al. . | |
| 4,708,255 | 11/1987 | Thompson | 215/344 X |
| 4,746,025 | 5/1988 | Krautkramer et al. | 220/258 X |
| 4,757,911 | 7/1988 | Larkin et al. . | |
| 4,770,325 | 9/1988 | Gordon et al. . | |
| 4,801,037 | 1/1989 | Hayashida et al. . | |
| 4,807,769 | 2/1989 | Gach . | |
| 4,828,127 | 5/1989 | Young et al. | 212/252 |
| 4,838,450 | 6/1989 | Bocchi . | |
| 4,850,503 | 7/1989 | Larsson | 220/270 X |
| 4,858,776 | 8/1989 | Mehra | 215/341 X |
| 4,887,765 | 12/1989 | Rausing . | |
| 4,948,003 | 8/1990 | Munoz . | |
| 5,069,372 | 12/1991 | Kawajiri . | |
| 5,176,300 | 1/1993 | Kishikawa et al. . | |
| 5,176,313 | 1/1993 | Curry et al. | 220/465 X |
| 5,249,695 | 10/1993 | Luch et al. | 229/125.15 X |
| 5,297,688 | 3/1994 | Beck et al. | 215/344 |
| 5,301,849 | 4/1994 | Guglielmini et al. | 222/541.9 X |
| 5,303,838 | 4/1994 | Luch et al. . | |

FOREIGN PATENT DOCUMENTS

| | | |
|---|---|---|
| 685952 | 5/1964 | Canada . |
| 1523236 | 5/1968 | France . |
| 2276370 | 9/1994 | United Kingdom . |

*Primary Examiner*—Stephen P. Garbe
*Attorney, Agent, or Firm*—Julian Caplan; Flehr Hohbach Test Albritton & Herbert LLP

[57] ABSTRACT

A fitment for use as a pour spout for a paper carton or flexible bag for liquids and powders has a flange which may be welded around a hole in the carton. A spout projecting outward from the flange is provided with a removable membrane integral with an inward projection positioned on the interior of the spout approximately midway of its height. Preferably the membrane is concave. A horizontally disposed pull ring is attached to the membrane by a connector so that pulling the ring removes the membrane by fracturing the tear line at the juncture of the outer edge of the membrane and the projection. A cap snaps over the spout and may be removed by unscrewing the complementary threads on cap and spout. A tamper-evidencing band frangibly connected to the lower edge of the cap skirt engages the exterior of the spout so that the cap cannot be removed without breaking the fragible connection.

23 Claims, 3 Drawing Sheets

FITMENT HAVING REMOVABLE MEMBRANE

CROSS REFERENCE TO RELATED APPLICATIONS

This application is a continuation of U.S. application Ser. No. 08/380,832,filed Jan. 30, 1995 now abandoned.

BACKGROUND OF THE INVENTION

1. Field of the Invention.

This invention relates to a new and improved fitment having a removable membrane which closes off the interior of the fitment spout. More particularly, the invention relates to a fitment which fits around and through a hole in a panel of a paperboard carton, or around a hole in a flexible container or the like, used for packaging liquids and powders and also to a closure for such fitment.

2. Description of Related Art.

Fitments having membranes are shown in such patents as U.S. Pat. No. 5,303,838, issued Apr. 19, 1994, and particularly FIGS. 14–16 thereof. Other patents showing membranes are U.S. Pat. No. 3,458,080, issued Jul. 29, 1969, U.S. Pat. No. 4,380,303, issued Apr. 19, 1983, and others. The present invention is an improvement on the prior art in that the membrane is located approximately midway of the height of the spout and is concave. Hence if the container on which the spout is attached is compressed, the membrane serves as a bellows to absorb such compression without danger of the membrane being detached from the spout of the fitment.

The fitment cap may be attached by downward, non-rotative motion and has a tamper-evidencing band engaging the fitment.

SUMMARY OF THE INVENTION

The fitment of the present invention comprises a spout portion having a peripheral flange which may be welded or otherwise attached to a panel of a paperboard carton or to a flexible plastic container. A spout projects upward from the flange and, in the preferred embodiment, is externally threaded adjacent its upper end. Approximately midway of the height of the spout is an internal membrane which is concave and is joined to an inward projection of the spout along a line of weakness. A ring is connected to the membrane in such fashion that by pulling the ring the membrane is detached from the inward projection of the spout. The concave membrane may serve as a bellows, as hereinabove explained. The concavity also facilitates the consumer gripping the ring and has certain advantages in molding the part.

The cap of the present invention has a skirt which is internally threaded to engage the threads of the spout. A lower portion of the cap has a tear band having a bead which snaps under a shoulder on the lower portion of the spout. The tear band is connected to the upper portion of the skirt by frangible means so that the cap may not be removed without giving evidence of tampering.

In one modification of the invention the cap is provided with a hollow plug depending from the top of the cap which seals against the inside of the upper end of the spout. As an alternate, the plug may be eliminated. It will be understood that after the cap has been removed and the membrane torn from the spout and a portion of the contents of the container dispensed, the cap may be used for reclosure purposes. In the alternate modification, a rib is formed on the underside of the top of the cap. When the cap is screwed back onto the spout, the rib engages the upper end of the spout to prevent leakage.

One of the features of the invention is the fact that the cap may be attached to the spout by pressing the cap downward relative to the spout, the mating threads on the spout and cap skirt slipping past each other and then interengaging. The tamper-evident band has a bead which engages a shoulder on the spout so that the cap cannot be unscrewed without severing the bridges which connect the band to the skirt and giving evidence of tampering. The tear band not only provides tamper-evidencing in addition to the membrane being intact, it also is anti-back-off feature to keep the cap from unscrewing even after the cap has been detached from the band.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Figure 1:
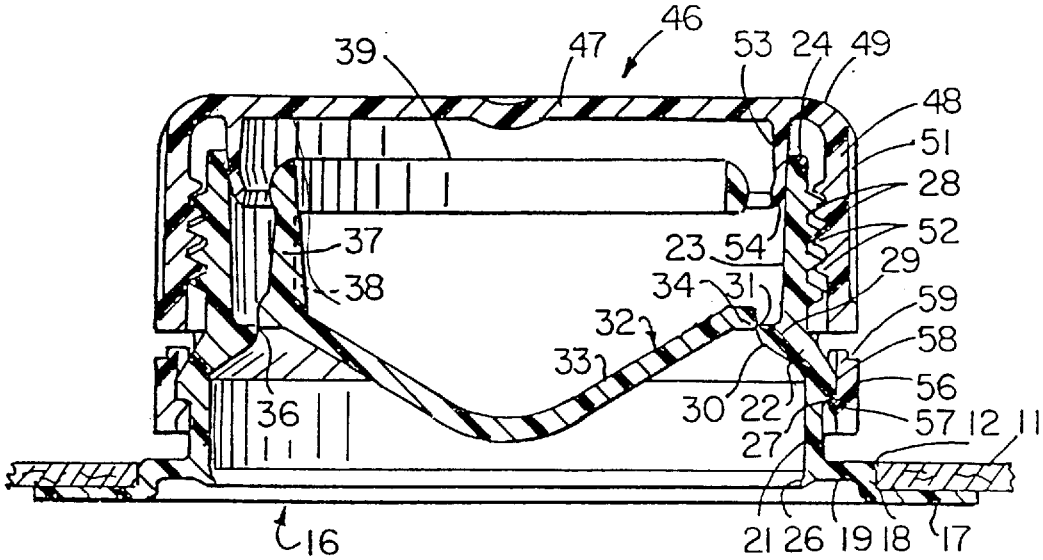
FIG. 1 is a vertical sectional view through the cap and spout in assembled condition.
Figure 3:
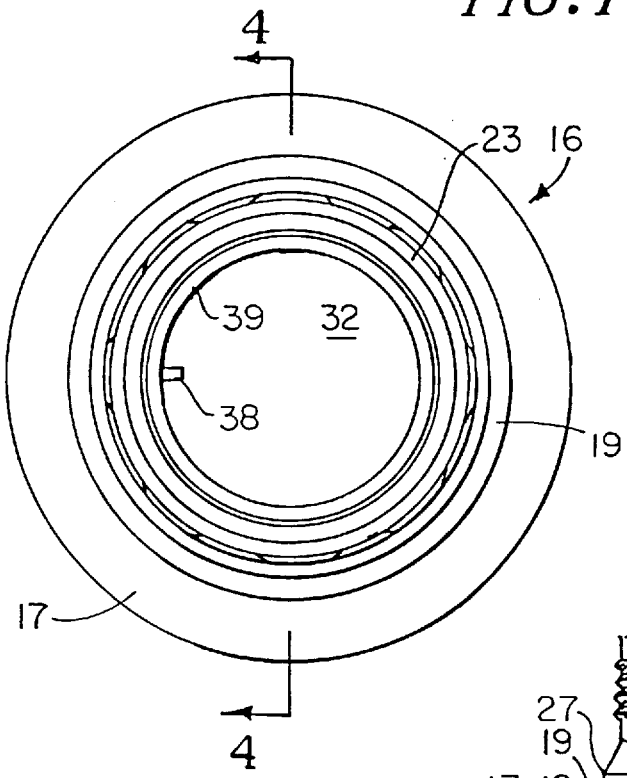
FIG. 3 is a top plan view thereof.
Figure 2:
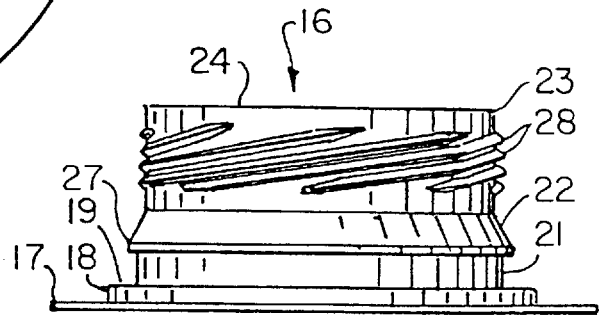
FIG. 2 is a side elevational view of the spout of the present invention.
Figure 4:
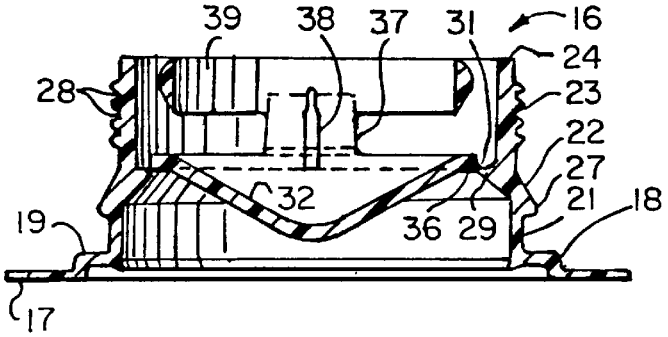
FIG. 4 is a vertical sectional view taken substantially along the line 4—4 of FIG. 3.
Figure 6:
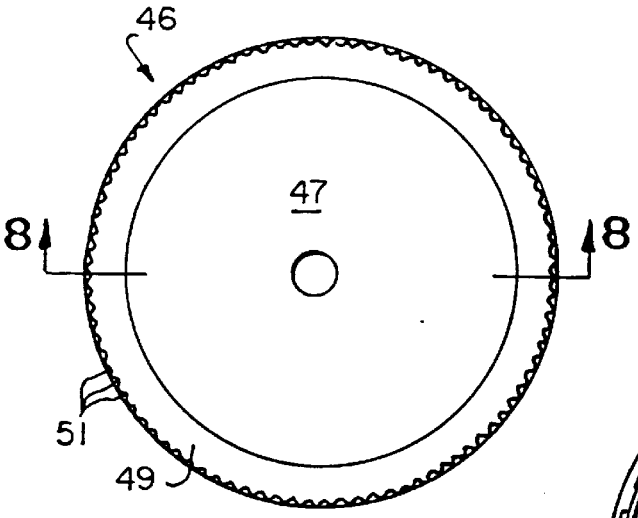
FIG. 6 is a top plan view of the cap of FIG. 5.
Figure 7:
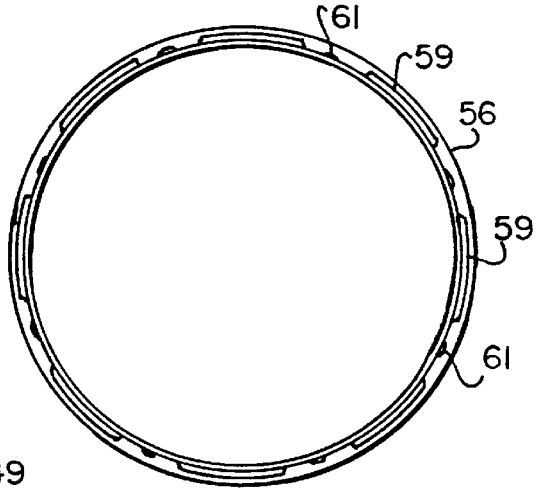
FIG. 7 is a horizontal sectional view taken substantially along the line 7—7 of FIG. 5.
Figure 5:
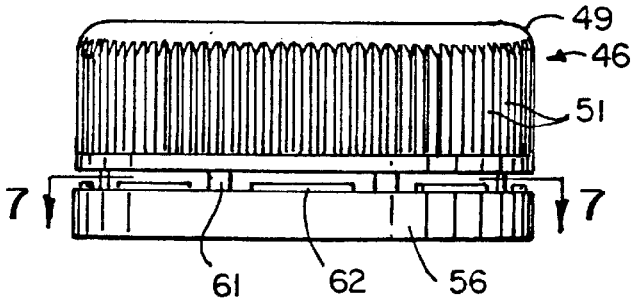
FIG. 5 is a side elevational view of the cap.
Figure 7A:
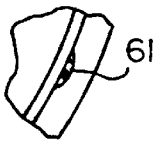
FIG. 7A is a fragmentary enlarged view of a portion of FIG. 7.
Figure 8:
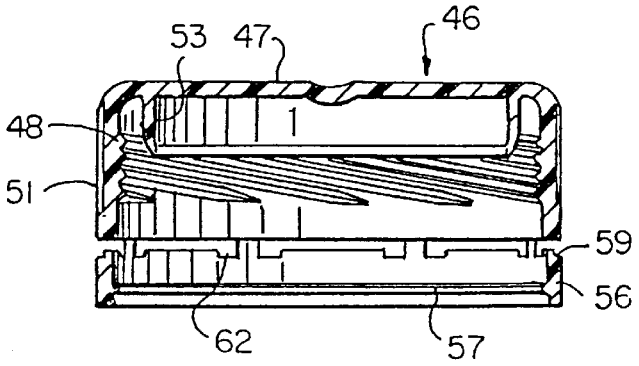
FIG. 8 is a vertical sectional view taken substantially along the line 8—8 of FIG. 6.
Figure 8A:
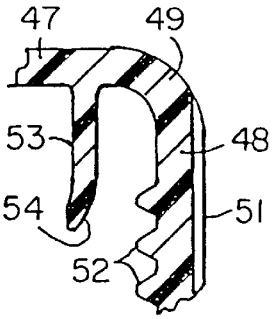
FIG. 8A is an enlarged fragmentary view of a portion of FIG. 8.
Figure 8B:
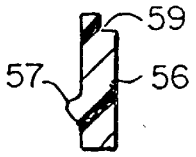
FIG. 8B is a fragmentary sectional view of a portion of FIG. 8.

One environment in which the present invention may be employed is by attachment to a carton panel 11 having a hole 12 therein. Fitment 16 is provided with a flange 17 which is welded or otherwise attached to the underside of panel 11 surrounding hole 12. Projecting up from the inner edge of flange 17 is a step 18 having an outside dimension to fit within the hole 12 and having a height approximately equal to the thickness of panel 1l. Above step 18, the fitment has an inward extending portion 19. Extending upward from the inner edge of portion 19 is lower spout stretch 21 and thereabove is an upward inward extending slanted stretch 22 which merges into a vertically extending upper stretch 23 terminating in a top edge 24. The inner and outer surfaces of the spout may be termed the "inner wall surface" and "outer wall surface", respectively.

Formed on the inside of the lower portion of lower spout stretch 21 is an inward downward slanted bead 26 having a purpose which hereinafter appears.

An external shoulder 27 is formed at the juncture of lower spout stretch 21 and slanted stretch 22 for the purpose of attachment to the tamper-evidencing band of the cap as herein after explained. On the interior of the spout at approximately the juncture of the slanted stretch 22 and the upper stretch 23 is an inward projection 29 having an upper inner corner 31. The underside of projection 29 and its juncture with lower spout stretch 21 is a curved surface 30 which facilitates dispensing the contents of the container. Projection 29 is approximately midway of the length of the spout. On the exterior of upper spout stretch 23 are external threads 28, here shown as eight in number, of an arcuate length of approximately 270°, and of shallow pitch.

Above and inward of corner 31 is membrane 32 molded integrally with the fitment 16. The central portion of membrane 32 is concave as shown by reference numeral 33. The lower outer edge 34 of membrane 32 joins the upper inner corner 31 of projection 29 and the connection therebetween is thin and constitutes a line of weakness or tear line 36. At one portion of member 32 is an upward connection 37 reinforced by thin vertical gusset 38 and connected to horizontal pull ring 39 which is located below the level of top edge 24. When the user grips ring 39 and pulls upward, the tear line 36 breaks and the membrane 32 may be removed.

Cap 46 used with fitment 16 has a top 47 from which depends an upper skirt 48 joined to top 47 by a downwardly rounded corner 49. On the exterior of upper skirt 48 are vertical ribs 51 which assist the user in unscrewing the cap from the fitment. Upper skirt 48 is provided with internal threads 52 mating with the external threads 28 of fitment 16. The shape of the threads is such that when the cap 46 is pressed vertically downwardly on fitment 16, the threads 52 slip over threads 28 and re-engage.

In the form of the invention shown in FIG. 1 and FIGS. 5–8, a hollow plug 53 is formed on the underside of top 57, and the lower outer corner thereof having a curved edge 54 which engages the inside of upper fitment 23 in a liquid tight seal.

A tamper-evident band 56 is integrally attached to the bottom of upper skirt 48 by means of 8 angularly-spaced frangible bridge connections 61, it being understood that the number and placement of such connections is subject to variation. Band 56 is provided with an internal bead 57 which snaps under shoulder 27 when the cap is applied to the fitment. To facilitate engagement of shoulder 27, an internal groove 58 is formed in band 56 immediately above internal bead 57. An external rabbet 59 is formed on the upper outer edge of band 56. A plurality of upwardly extending bumpers 62 are formed on the upper edge of band 56 inside rabbet 59 and between frangible connections 61. Such bumpers 62 are used to keep the band 56 from collapsing when the cap is removed from the injection mold in which it is formed. Further, during assembly of the cap to the spout by a snap-on action, the bumpers reduce the tendency of the band 56 to collapse and for connections 61 to be prematurely broken. Because of rabbet 59 the consumer can more readily observe whether connections 61 are intact and thus detect tampering.

Figure 9:
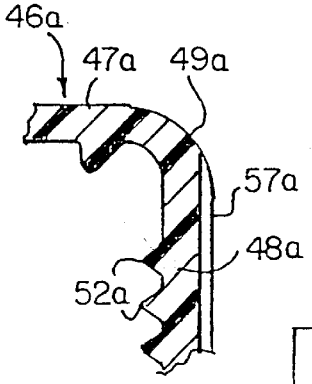
FIG. 9 is a view similarly to FIG. 8A of a modified cap.

In the modification shown in FIG. 9, the plug 53 is eliminated. Formed depending from the underside of top 47*a* is a bead 66 considerably shorter than plug 53. It will be understood that after the cap 46 has been unscrewed from fitment 16 and membrane 32 removed, the user may wish to dispense only part of the contents of the container. The upper portion of cap 46 serves as a reclosure cap. Bead 66 engages the interior of the upper stretch 23 of the spout. In other respects the modification of FIG. 9 resembles that of the preceding modifications and the same reference numerals followed by the subscript a are used to designate corresponding parts.

Figure 10:
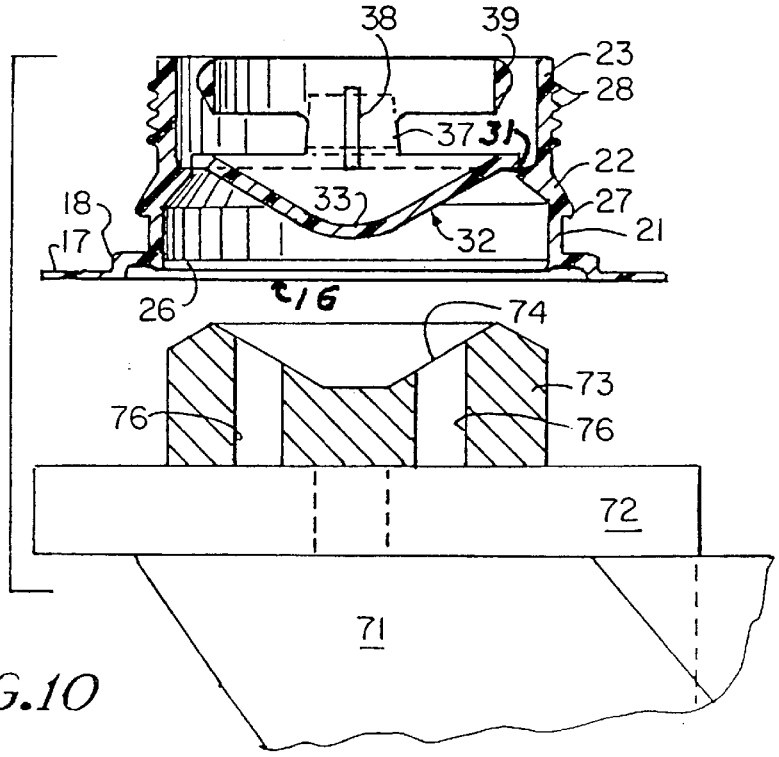
FIG. 10 is a schematic view showing how the fitment may be temporarily attached to the spud of an anvil of a machine for inserting the fitment into a panel of a carton.

Directing attention to FIG. 10, automatic equipment for welding the fitment flange 17 to the underside of panel 11 is known in the art. In one form of such equipment an anvil or mandrel 71 has a flange 72 to which is attached a spud 73 which picks the fitment off of a chute (not shown) by fitting inside the lower spout stretch 21. The lowest portion of the concave area 33 of membrane 32 is above the upper edge of spud 73. In the form of the invention shown in FIG. 10, spud 73 has an external diameter such that when it is inserted through the lower end of the fitment 16 the inner bead 26 frictionally engages the exterior of spud 73. The spud is formed with a concavity 74 so as not to conflict with the concavity 33 of membrane 32. Holes 76 in spud 73 relieve any vacuum which might tend to impede release of fitment 16 from spud 73 when the fitment has been positioned in the carton panel 11, as shown in FIG.1.

For purpose of convenience, as used in the accompanying claims "upper", "lower", "upward", "downward", "above" and "below" refer to the position of the fitment shown in the accompanying drawings. It will be understood that during manufacture, attachment and use, the parts may be positioned in other orientations.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A fitment comprising an annular spout flange, a spout projecting upward from said flange having an upper and a lower end and an inner and an outer wall surface, a membrane integral with said spout sealing off said spout, said membrane having a peripheral edge joined to said inner wall surface along a circumferential line of weakness, said line of weakness being spaced upward from said lower end a distance substantially midway of the distance between said flange and said upper end, an internal bead on said inner wall surface adjacent said lower end;

said inner wall surface being unobstructed above said internal bead substantially to said line of weakness, whereby a spud inserted in said lower end may detachably engage said internal bead and extend substantially up to said line of weakness, and a pull tab disposed above said membrane and below said upper end connected to said membrane by a connector.

2. A fitment according to claim 1 in which said membrane is concave.

3. A fitment according to claim 1 in which said inner wall is formed with an inward projection and said peripheral edge is joined to said projection.

4. A fitment according to claim 3 in which said projection has an upper inner first corner and said edge of said membrane has an outer lower second corner, said second corner being disposed above and inward of said first corner and joined thereto at said line of weakness.

5. A fitment according to claim 1 in which said pull tab comprises a ring.

6. A fitment according to claim 1 which further comprises a vertical gusset on said connector, said gusset being narrower than said connector.

7. A fitment according to claim 1 in which said inner wall surface comprises a cylinder above said bead, said cylinder having a height substantially greater than the height of said bead.

8. A fitment according to claim 7 in which said inner wall surface is formed with an upward-inward stretch above said cylinder, said upward-inward stretch terminating approximately at said line of weakness, whereby upon insertion of said spud into said lower end, the spud is in contact with said upward-inward stretch.

9. A fitment according to claim 1 in which said outer wall surface of said spout is formed with first threads and which further comprises a cap comprising a top and a depending skirt having an internal wall, second threads on said internal wall mating with said first threads, said first and second threads being formed dimensioned so that said cap may be applied to said spout by a straight, downward motion without relative rotation of said cap and spout, said threads deforming to slip past each other and then re-engage.

10. The fitment of claim 9 which further comprises a tamper-evidencing band below said skirt having internal spout-engaging means, frangible connecting means connecting an upper edge of said band to a lower edge of said skirt, said tamper-evidencing band having a lower edge positioned above said flange, said spout having band engaging means interengaging when said cap is applied to said fitment by a straight, downward motion without relative rotation of said cap and said fitment, said cap being secured to said spout so long as said frangible connector is intact and said cap cannot be removed from said fitment without fracturing said frangible connecting means.

11. A fitment according to claim 1 in which said inner wall surface is formed with an inward projection and said peripheral edge is joined to said projection.

12. A fitment according to claim 11 in which said projection has an upper inner first corner and said edge of said membrane has an outer lower second corner, said second corner being disposed above and inward of said first comer and joined thereto at said line of weakness.

13. A fitment according to claim 1 in which said pull tab comprises a ring.

14. In combination, a mandrel having a spud, said spud having predetermined dimensions and a fitment, said fitment comprising, an annular spout flange, a spout projecting upward from said flange having an upper and a lower end and an inner and an outer wall surface, a membrane sealing off said spout having a peripheral edge joined to said inner wall surface along a line of weakness, said line of weakness being spaced upward from said lower end said spout being unobstructed from said lower end up to said line of weakness, a pull tab disposed within said spout connected to and above said membrane, said inner wall surface being dimensioned to detachably engage said spud when said spud is inserted through said lower end to prevent unintentional disengagement of said spud from said fitment, and first threads on said outer wall surface, and a cap comprising a top and a depending skirt having a skirt internal wall surface, second threads on said skirt internal wall surface mating with said first threads, said first and second threads being formed and dimensioned so that said cap may be applied to said fitment by a straight, downward motion without relative rotation of said cap and said fitment, said threads being formed to slip past each other and then re-engage.

15. The combination of claim 14 which further comprises an internal bead on said inner wall surface, said bead being dimensioned slightly less than said spud, said bead detachably engaging said spud when said spud is inserted in said lower end.

16. The combination of claim 14 which further comprises a tamper-evidencing band below said skirt having internal spout-engaging means, frangible means connecting an upper edge of said band to a lower edge of said skirt, said tamper-evidencing band having a lower edge positioned above said flange, said spout having band engaging means on said outer wall, said spout engaging means and said band engaging means interengaging when said cap is applied to said fitment by a straight, downward motion without relative rotation of said cap and said fitment, said cap being secured to said spout so long as said frangible means is intact and said cap cannot be removed from said fitment without fracturing said frangible means.

17. A fitment according to claim 1 in which said frangible connecting means comprises angularly spaced bridge connections.

18. A fitment according to claim 14 which further comprises a spout-engaging means on the underside of said top shaped to seal with said inner wall of said spout.

19. A fitment according to claim 18 in which said spout-engaging means comprises a hollow plug.

20. A fitment according to claim 18 in which said third spout-engaging means comprises a hollow plug.

21. A fitment according to claim 18 in which said spout engaging means comprises a bead engageable with said spout upon reclosure of said cap on said spout after initial removal of said cap from said fitment.

22. A fitment comprising an annular spout flange, a spout projecting upward from said flange having an upper end and a lower end and an inner and an outer wall surface, a membrane integral with said spout sealing off said spout, said membrane having a peripheral edge joined to said inner wall surface along a circumferential line of weakness, said line of weakness being spaced upward from said lower end, said inner wall surface being unobstructed above said lower end substantially to said line of weakness, whereby a spud inserted inside said lower end detachably engages said lower end and extends substantially up to said line of weakness, a pull tab disposed above said membrane and below said upper end, and a connector between said pull tab and said membrane.

23. A fitment comprising an annular spout flange, a spout projecting upward from said flange having a lower end and an upper end and an inner and an outer wall surface, a membrane integral with said spout, sealing off said spout and having a line of weakness, a pull tab disposed within said spout connected to and above said membrane, whereby upon pulling said pull tab said membrane is at least partially detached from said spout along said line of weakness, said membrane being spaced upward from said lower end a distance sufficient so that a spud inserted in said lower end detachably engages said spout by fitting inside said lower end to prevent unintentional disengagement of the spud from said fitment, said membrane being spaced below said upper end a sufficient distance for said pull tab to be positioned within said inner wall surface and below said upper end.

* * * * *